US006634766B1

(12) United States Patent
Gordon

(10) Patent No.: US 6,634,766 B1
(45) Date of Patent: Oct. 21, 2003

(54) ORNAMENTAL LIGHTING

(76) Inventor: Donovan Gordon, 13 SW. 13th St., Deerfield Beach, FL (US) 33441

( * ) Notice: Subject to any disclaimer, the term of this patent is extended or adjusted under 35 U.S.C. 154(b) by 0 days.

(21) Appl. No.: 10/139,566

(22) Filed: May 6, 2002

(51) Int. Cl.[7] ..... F21V 21/00

(52) U.S. Cl. ..... 362/249; 362/806; 362/252; 362/239

(58) Field of Search ..... 362/249, 250, 362/806, 123, 252, 238, 239

(56) References Cited

U.S. PATENT DOCUMENTS

| | | | | | |
|---|---|---|---|---|---|
| 638,895 | A | * | 12/1899 | Wallis | 362/252 |
| 2,309,977 | A | * | 2/1943 | Peroni | 428/8 |
| 2,402,766 | A | * | 6/1946 | Moore | 439/416 |
| 3,985,924 | A | * | 10/1976 | Pritza | 428/9 |
| 4,870,547 | A | | 9/1989 | Crucefix | |
| 5,422,801 | A | | 6/1995 | Sangalli, Jr. | |
| D360,701 | S | | 7/1995 | Glasstetter | |
| 5,517,390 | A | * | 5/1996 | Zins | 362/123 |
| 5,550,720 | A | | 8/1996 | Carroll | |
| 5,609,412 | A | * | 3/1997 | Contigiani | 362/249 |
| 6,228,442 | B1 | | 5/2001 | Coco | |
| 6,254,250 | B1 | | 7/2001 | Shieh | |

FOREIGN PATENT DOCUMENTS

| | | | | | |
|---|---|---|---|---|---|
| FR | 2636827 | A1 | * | 3/1990 | A47G/33/16 |
| GB | 2161595 | A | * | 1/1986 | F21V/33/00 |

* cited by examiner

*Primary Examiner*—Stephen Husar
*Assistant Examiner*—Sharon Payne
(74) *Attorney, Agent, or Firm*—Mark D. Bowen, Esq.; Stearns Weaver Miller Weissler Alhadeff & Sitterson, P.A.

(57) ABSTRACT

A lighting apparatus adapted for installation in a variety of configurations to provide decorative illumination is disclosed. The apparatus includes a frame formed by a spine member and a plurality of spaced elongate bendable arm members connected to the spine member. Each arm member has a plurality of electric lambs connected thereto. The arms and spine are each semi-rigid to provide a supporting frame, and are further bendable so as to enable the structure to be formed into a variety of different configurations. The lighting apparatus is specifically adapted for use in decorating trees and/or columns by aligning the apparatus with the trunk of the tree and bending opposing arms around the trunk such that the trunk is encircled with lights. Electrical connectors allow a plurality of lighting devices to be connected in series thereby forming very large illumination displays. Alternatively, the apparatus may be installed in a horizontal configuration along the roofline of a house or building with the arms configured so as to hang downward to form illuminated display resembling suspended icicles.

3 Claims, 10 Drawing Sheets

ORNAMENTAL LIGHTING

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights.

BACKGROUND OF THE INVENTION

1. Field of the Invention

This invention relates to electric lighting, and, more particularly, to a lighting apparatus adapted for installation in a variety of configurations to provide ornamental and decorative illumination.

2. Description of the Background Art

Decorative light strings are widely used in a variety of indoor and outdoor illumination applications such as holiday displays, particularly Christmas displays, festivals, and varied other applications. Conventional decorative light strings typically comprise electrical wires connected to a number of lamp sockets mounted thereon for receiving individual lamps. Since the electrical wires are not rigid, the light strings are typically installed in various configurations relying on fasteners for support. For example, light strings are used to decorate buildings and houses, trees, and countless other structures secured by staples, nails, or adhesive mounting devices. Affixing light strings to various structures using the above-referenced fastening methods has proven time consuming and difficult. Furthermore, it is often undesirable to place nails and staples into walls or other parts of a structure solely for the purpose of supporting ornamental lights often for short periods, such as days or weeks.

As a result of the recognized and inherent disadvantages associated with conventional light strings, others have disclosed various modifications directed to overcoming various disadvantages. U.S. Pat. No. 4,870,547, issued to Crucefix, entitled "Christmas Tree Lights," discloses a light assembly that is limited to use with a conically shaped Christmas tree. The light assembly requires a collar adapted for mounting on the top of the tree, and includes a plurality of light strings, each having an end connected to the collar, which drape down the tree. U.S. Pat. No. 5,550,720, issued to Carroll, discloses an artificial Christmas tree having branches that incorporate electric lights for the illumination of the branches. U.S. Pat. No. 6,228,442, issued to Coco, discloses an ornamental lamp post, adapted by clamping a split sleeve around an outdoor lamp post, so as to include a plurality of radially projecting branches, each of which branches may incorporate multiple electrical lights. U.S. Pat. No. 5,422,801, issued to Sangalli, Jr., discloses a Christmas tree light ring arrangement wherein a plurality of light rings are arranged for mounting about a Christmas tree trunk.

While the illumination devices disclosed in the background art are generally suitable for their intended purposes, the devices are limited to certain intended uses. More particularly, none of the lighting devices of the background art are specifically adaptable for installation in a variety of horizontal and/or vertical configurations and on a variety of structures, such as trees, houses, and other structures. Accordingly, there remains a need for a lighting apparatus adapted for installation in a variety of configurations to provide decorative illumination.

BRIEF SUMMARY OF THE INVENTION

The present invention addresses and overcomes the disadvantages and shortcomings in the art by providing a lighting apparatus having a bendable frame structure adapted for installation in a variety of vertical and/or horizontal configurations to provide decorative illumination. In a preferred embodiment, a lighting apparatus in accordance with the present invention includes an elongate bendable spine member having a plurality of elongate bendable arm members, each having a plurality of electric lambs, connected thereto in spaced relation. The various electric lamps are each connected to electric conductors for receiving electrical power, and electrical connectors (male and female) are provided for connection to an electrical power source and for stringing a number of lighting apparatus together to form larger composite illumination configurations.

The arms and spine member form a frame structure having multiple projecting illuminated arms. The arms and spine member are preferably bendable so as to enable the structure to be shaped into a variety of different configurations. For example, the apparatus may be installed in an operative configuration to decorate trees by aligning the apparatus spine with the trunk of the tree and bending opposing illuminated arms around the trunk such that the trunk is substantially encircled with lights. A plurality of illumination devices may be connected in series thereby forming very large illumination displays. Accordingly, large trees may be decorated by installation of a plurality of illumination devices on the tree trunk and branches. In an alternate configuration, the apparatus may be installed in a horizontal configuration along the roofline of a house or building with the arms configured so as to hang downward to form illuminated display resembling suspended icicles, with a plurality of lighting devices may be connected in series to stretch substantially around the perimeter of the building or structure.

The present invention thus provides a lighting apparatus specifically designed for providing an adaptable illumination structure suitable for use in decorating and illuminating trees, columns, fences, and various portions of residential and/or commercial structures.

Accordingly, it is an object of the invention to provide an improved decorative lighting apparatus.

Another object of the present invention is to provide an adaptable and self-supporting lighting apparatus.

Yet another object of the present invention is to provide a lighting apparatus designed for installation on trees to illuminate the trunk and branches without requiring supplemental fasteners.

Still further objects and advantages will become apparent from a consideration of the ensuing description and drawings.

DETAILED DESCRIPTION OF THE INVENTION

Figure 10:
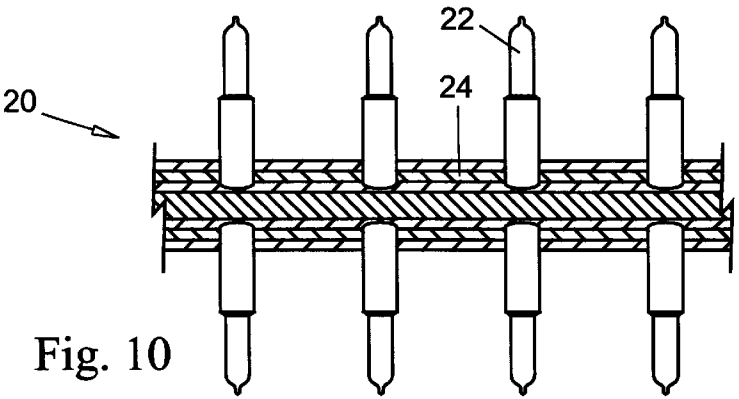
FIG. 10 is a partial sectional view thereof.
Figure 9:
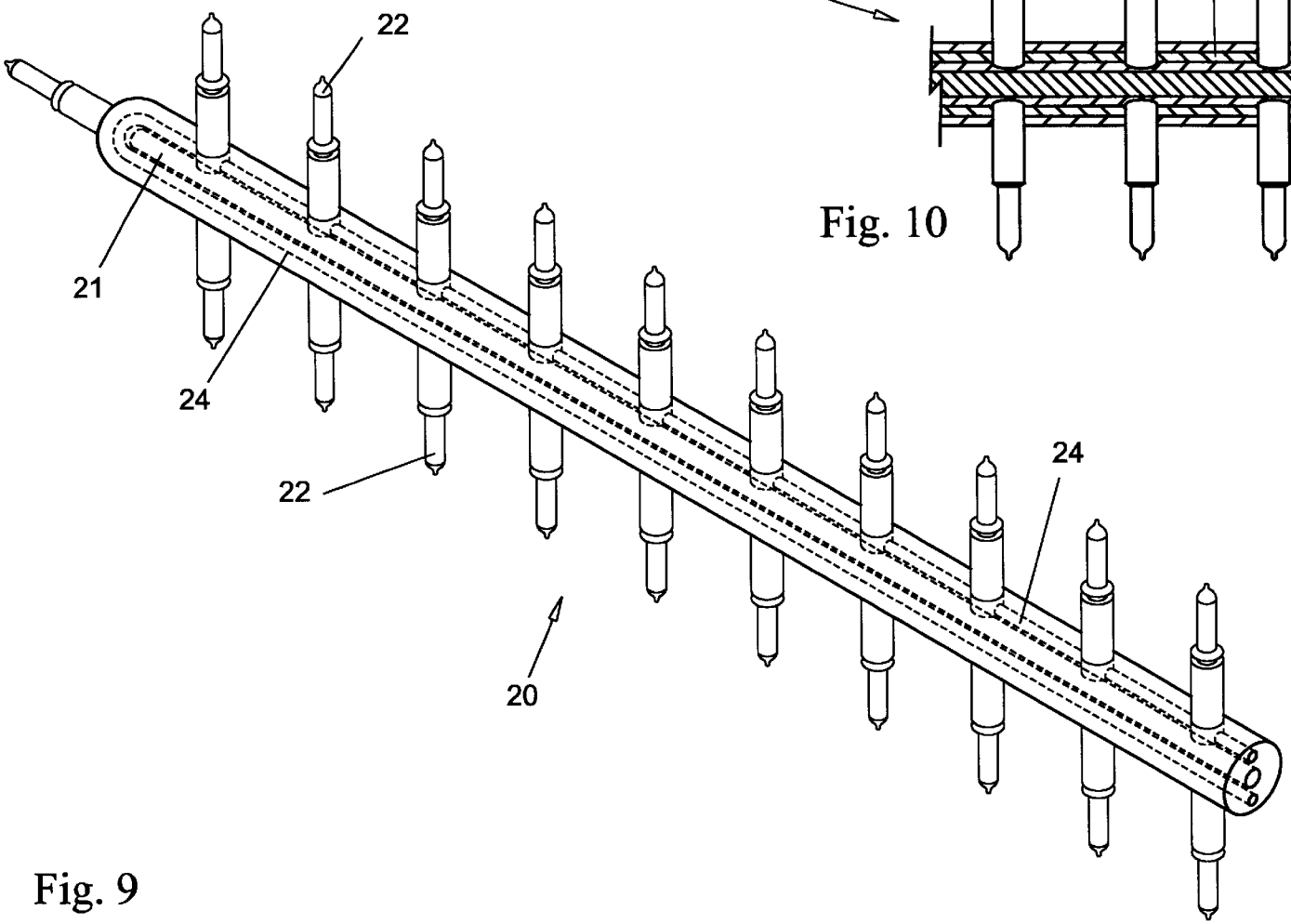
FIG. 9 is a partial detail view of an illuminated arm of the apparatus.
Figure 11:
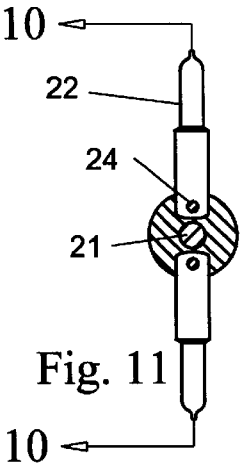
FIG. 11 is a cross-sectional view of one of the projecting arms.

With reference now to the drawings, FIGS. 1–14 depict a preferred embodiment of a decorative lighting apparatus according to the present invention, generally referenced as 10. Turning to FIGS. 1–7, apparatus 10 includes a bendable frame assembly including a plurality of elongate arms, generally referenced as 20, projecting from a centrally disposed spine member 30. As best seen in FIGS. 9–11, each arm 20 and spine member 30 are formed about an elongate, bendable metal wire 21 having a plastic coating 23 covering the outer surface thereof. Metal wire 21 is of suitable diameter so as to be self-supporting while remaining omnidirectionally bendable so as to enable the user to adapt and form the arms and/or spine member into various configurations as more fully discussed hereinbelow.

Arms 20 further include a plurality of electric lamps, each generally referenced as 22. Lamps 22 are each connected to an arm 20 and are electrically connected via insulated electrically conducting wires 24, which wires are preferably routed along the respective arms as best depicted in FIGS. 9–11. In a preferred embodiment, conducting wires are substantially covered by the plastic coating to protect the wires and to prevent entanglement. Conducting wires are electrically connected to electrical connectors for providing power to lamps 22.

Figure 1:
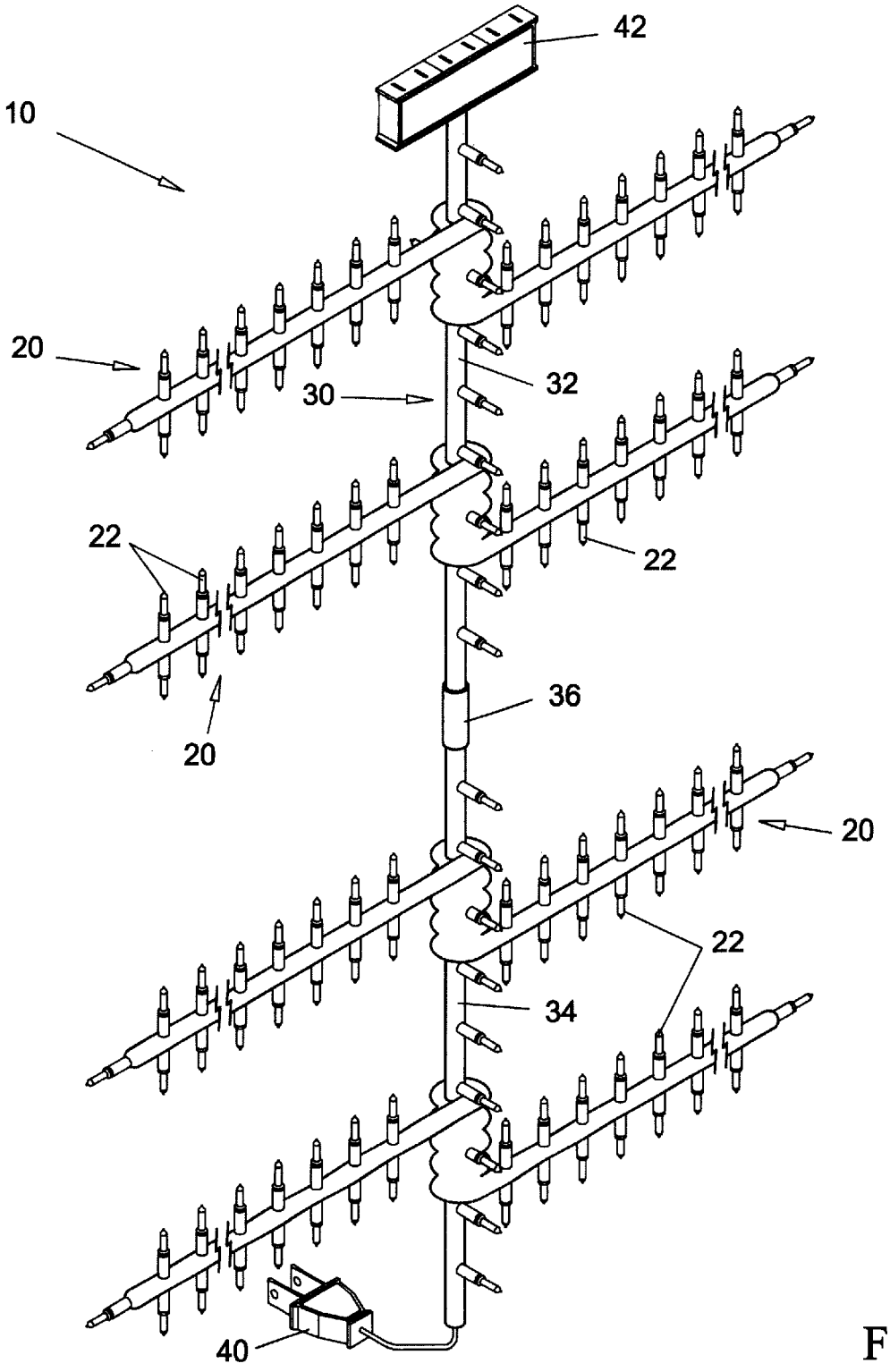
FIG. 1 depicts a perspective view of a lighting apparatus in accordance with the present invention.
Figure 2:
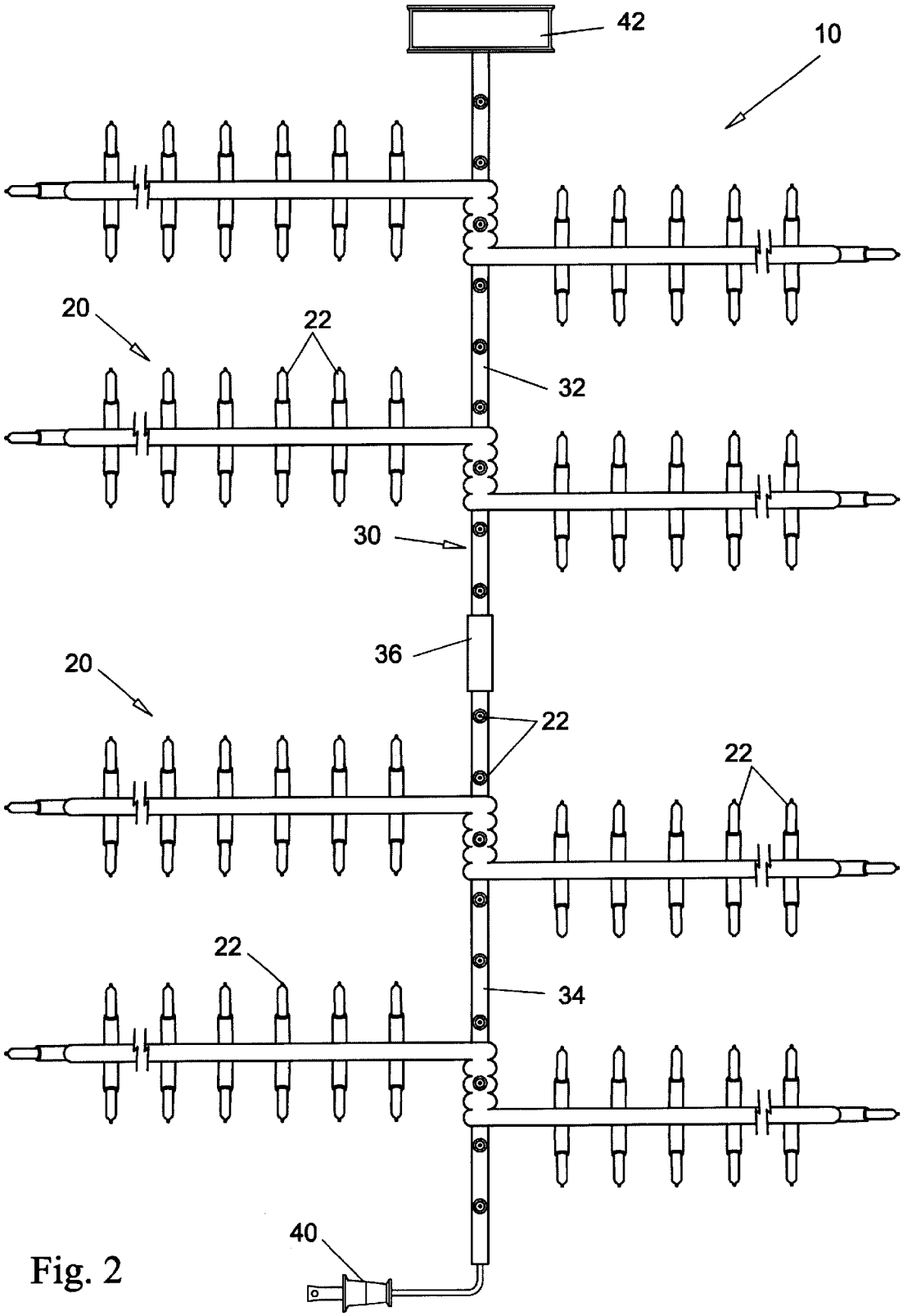
FIG. 2 is a front view thereof.
Figure 3:
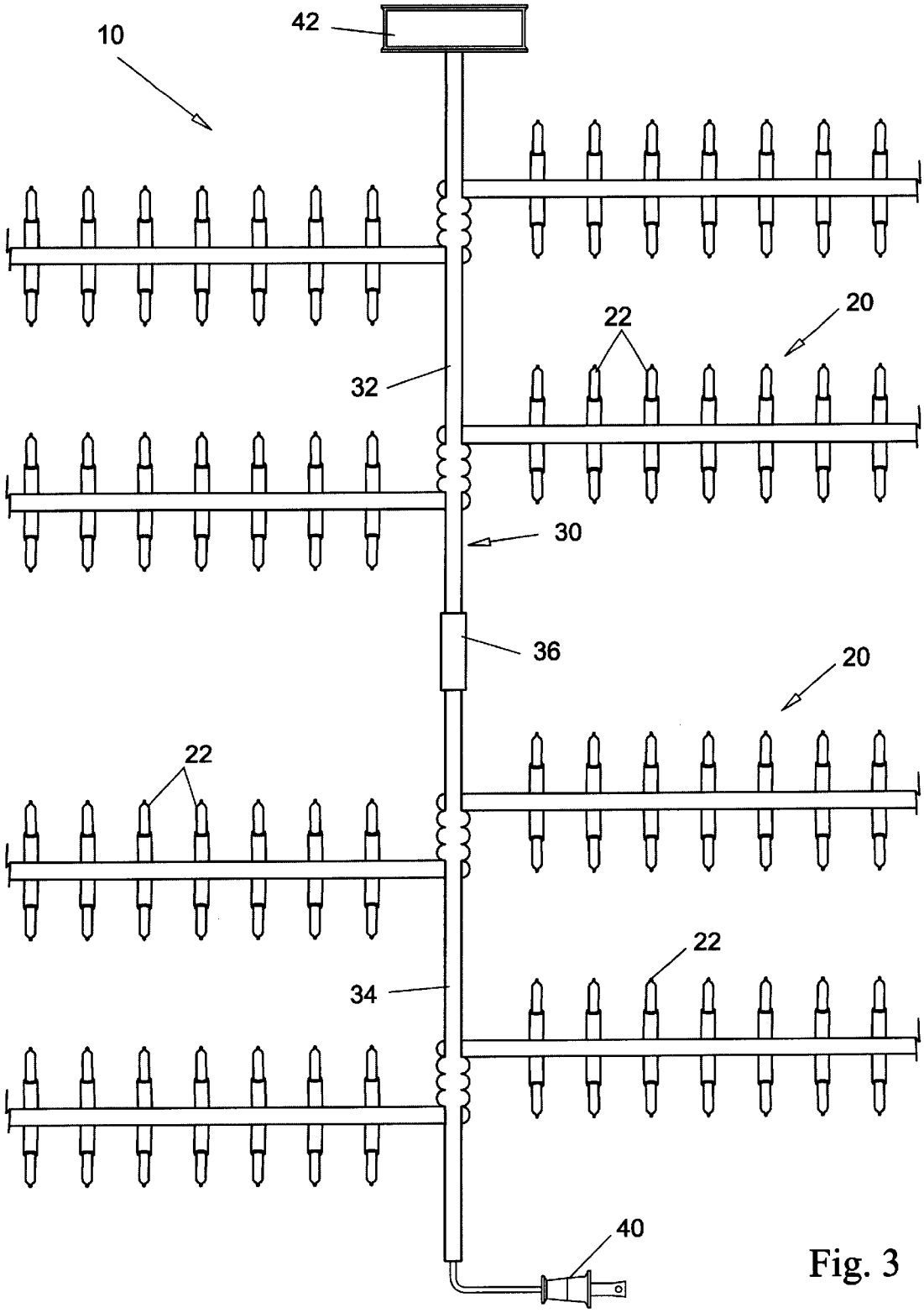
FIG. 3 is a rear view thereof.
Figure 4:
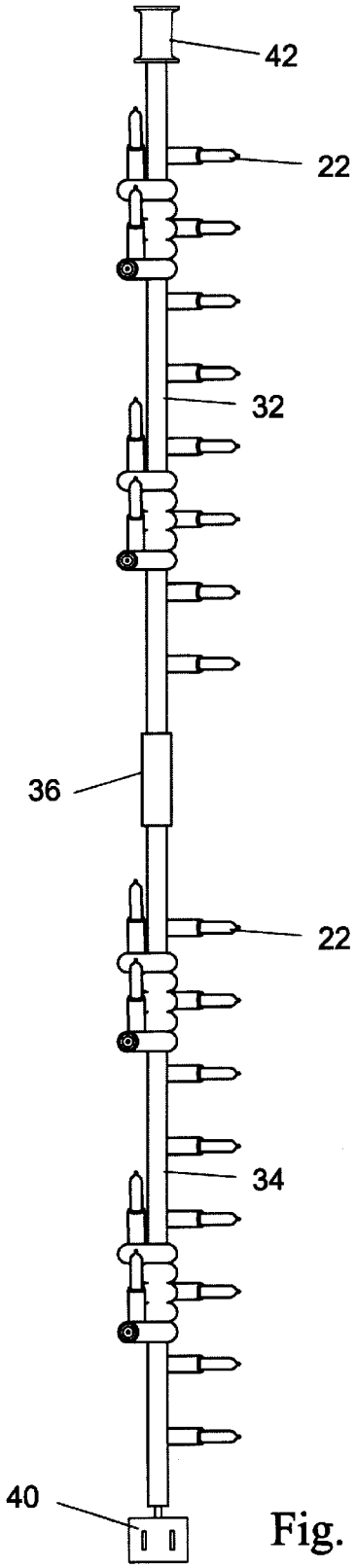
FIG. 4 is a left side view thereof.
Figure 5:
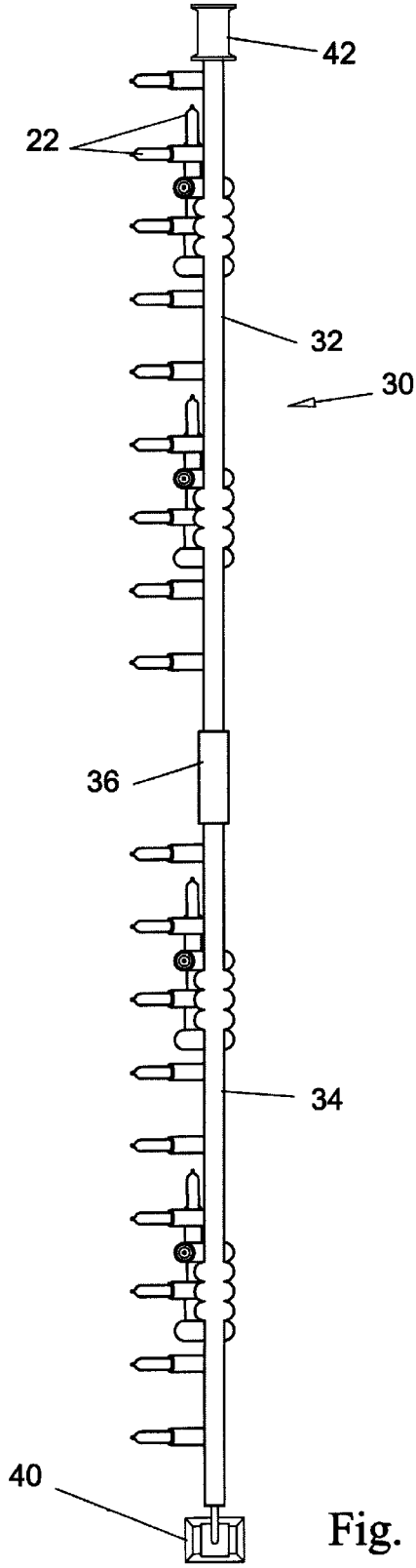
FIG. 5 is a right side view thereof.
Figure 6:
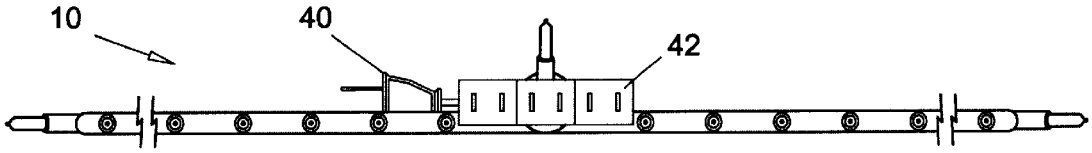
FIG. 6 is a top view thereof.
Figure 7:
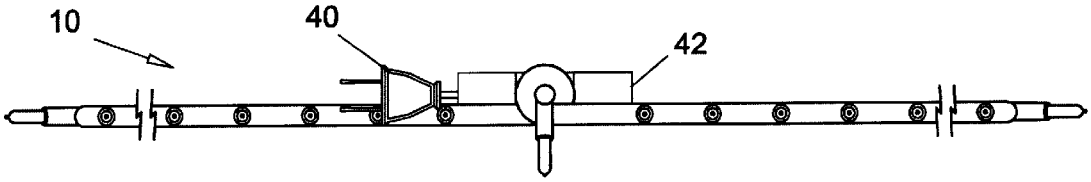
FIG. 7 is a bottom view thereof.
Figure 8:
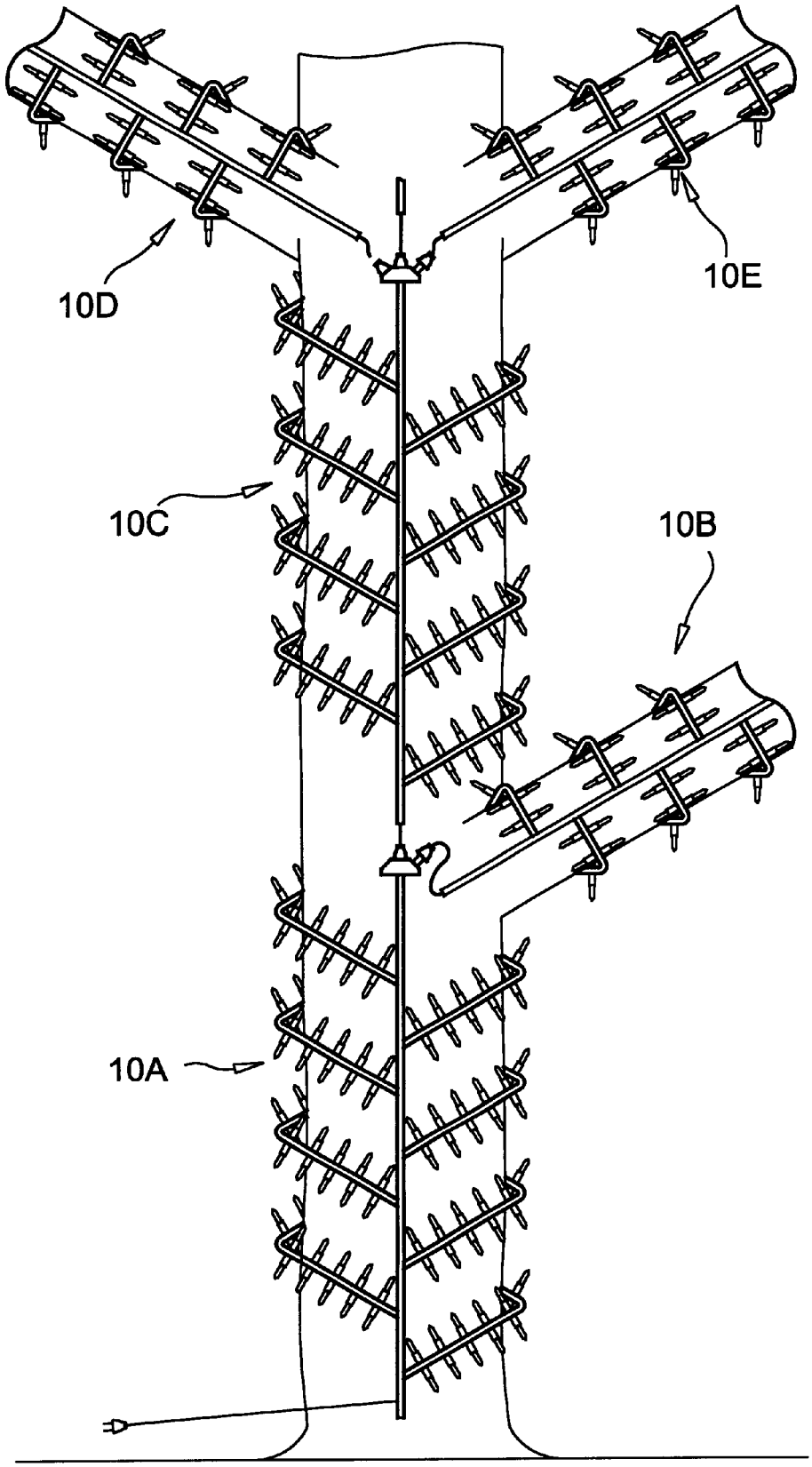
FIG. 8 illustrates a plurality of lighting apparatus in accordance with the present invention installed for decorative illumination on a tree trunk and branches.
Figure 14:
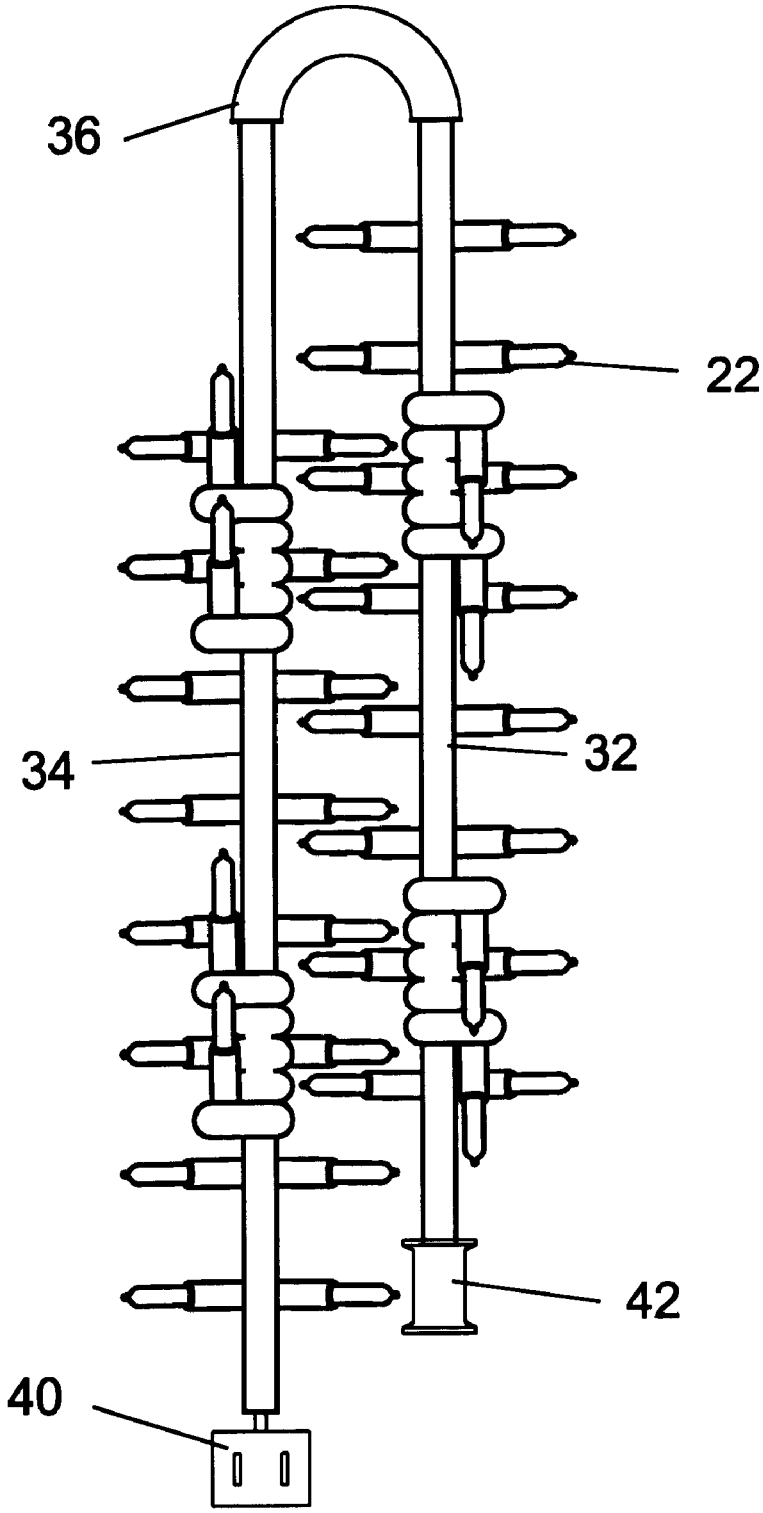
FIG. 14 illustrates a lighting apparatus in a folded configuration for storage.

As best depicted in FIGS. 1–3, arms 20 are each connected to spine member 30 and may generally project from opposing sides in a longitudinally spaced branch-like configuration. An important aspect of the invention relates to the length of the various arms. More particularly, arms projecting from one side of spine 30 are preferably longer than the arms projecting from the opposing side of spine 30 for reasons more fully discussed herein below. Spine 30 is preferably fabricated of plastic coated wire of a suitable diameter so as to be capable of supporting arms 20 while remaining bendable to allow for bendable modification thereof. As depicted in FIG. 1, arm structures may be formed from a plurality of elongate members, each of which is connected to spine member 30 so as to form a secure connection therebetween while forming a pair of arms projecting from opposing sides of spine 30. Spine member 30 preferably includes first and second sections, referenced as 32 and 34 respectively, each of which sections preferably include lights 22 in spaced relation along one side thereof. Having lights on one side of spine member 30 facilitates installation as the back side is free of projecting lights. Accordingly, the apparatus may be installed substantially adjacent to any surface. Spine sections 32 and 34 are preferably connected by a flexible connector 36 to allow for relative angular positioning of spine member 30, and to allow for folding of the lighting apparatus such that spine sections 32 and 34, and the various arms connected thereto, may be folded upon one another in a compact configuration for storage. Flexible connector 36 may be a section of hollow rubber tubing, or any other suitable flexible connecting member. A significant advantage realized by incorporating a flexible connector at an intermediate point on spine 30 relates to folding apparatus 10 into a compact configuration for storage as best depicted in FIG. 14.

Electric power is supplied to lamps 22 via conductor wires 24 which wires are electrically connected to a male electrical connector, namely, electrical plug 40, which is preferably disposed in proximity to a first end of lighting apparatus 10. In addition, conductor wires 24 are further connected to at least one female electrical connector 42, which is preferably disposed in proximity to a second end of lighting apparatus 10. In a preferred embodiment, connector 42 is a multiple outlet connector having three individual outlets thus allowing for the connection of three additional lighting devices in series electrical connection.

Figure 12:
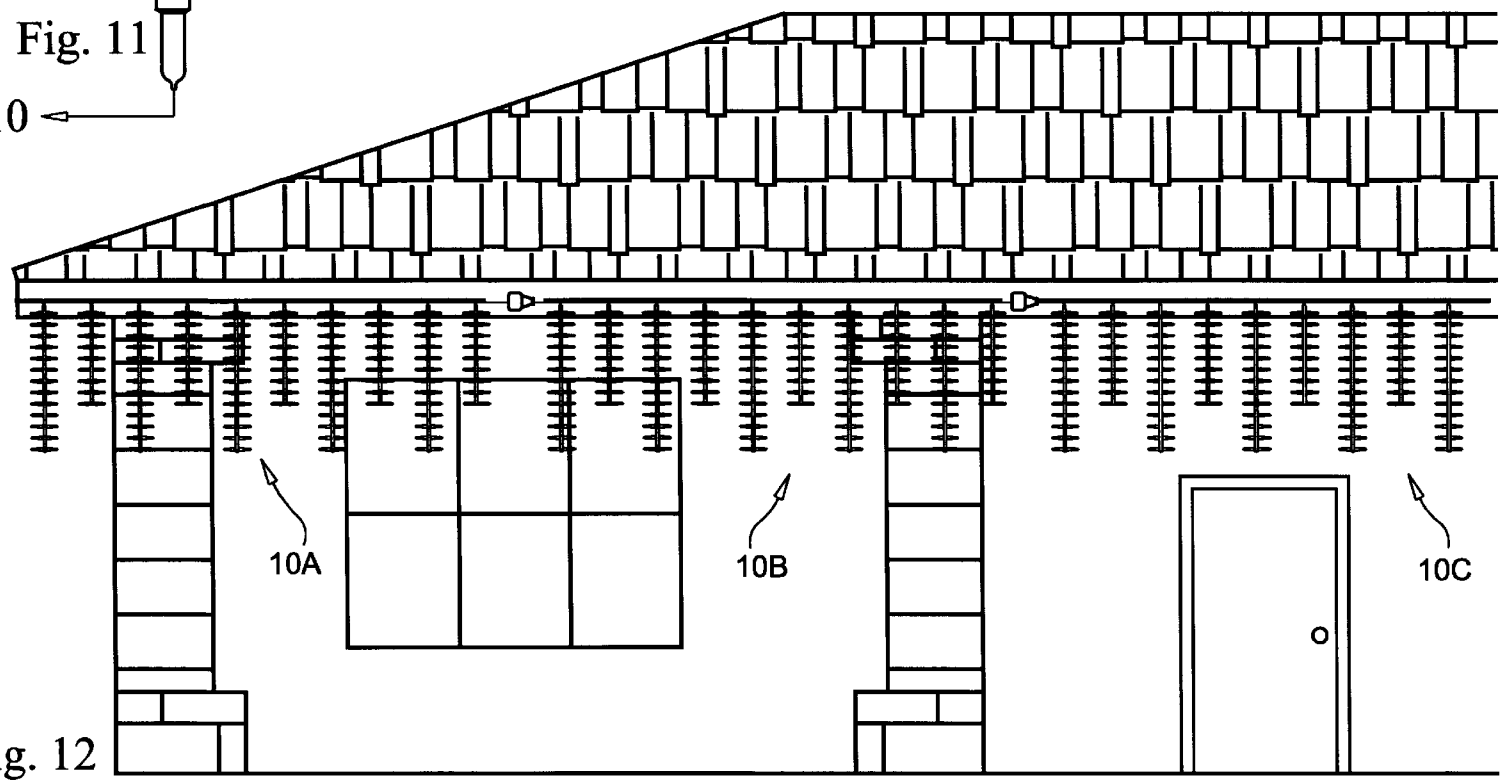
FIG. 12 illustrates a plurality of lighting apparatus installed for decorative illumination of the roofline of a residential structure.
Figure 13:
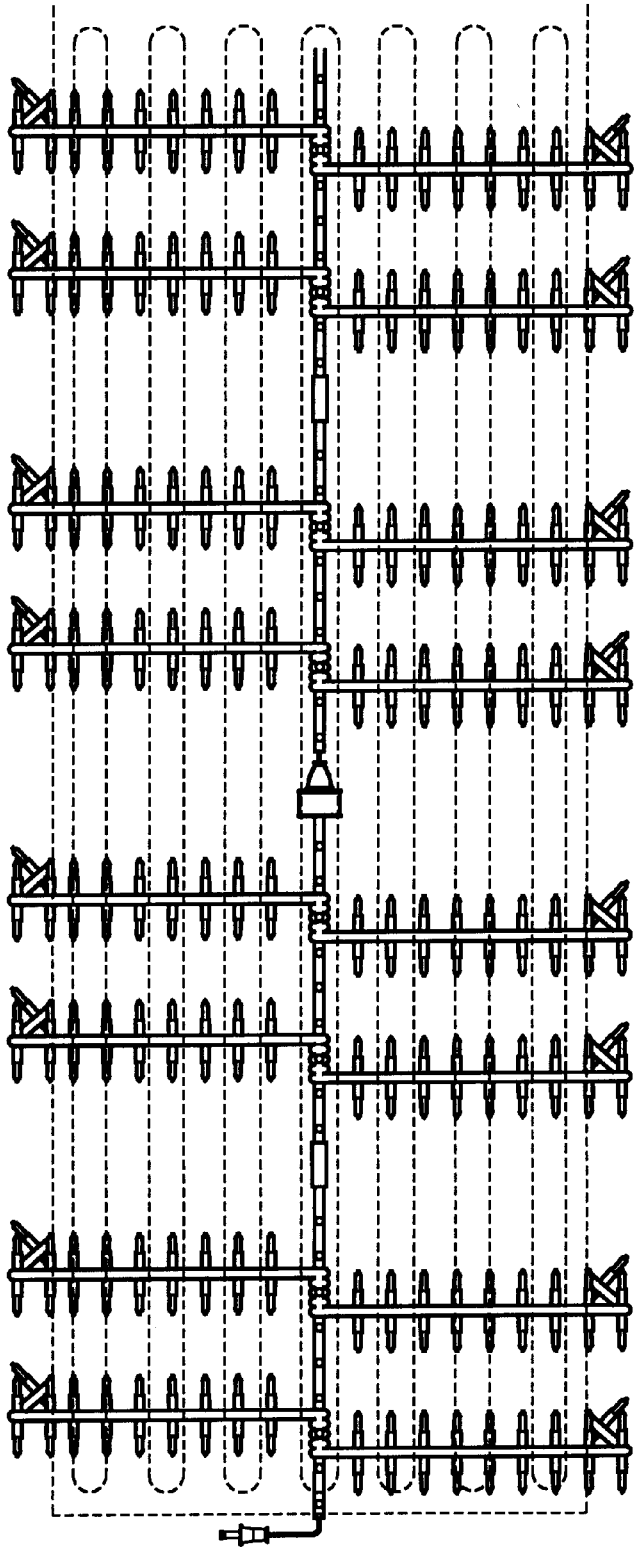
FIG. 13 illustrates a plurality of light apparatus installed for decorative illumination of an architectural column.

As noted hereinabove, a significant feature of the lighting apparatus of the present invention relates to the functionality of arms 20 and spine 30 each of which, as noted hereinabove, are bendable so as to enable the structure to be formed and shaped into a variety of self-supporting configurations. Accordingly, illustrated in FIGS. 8 and 13, lighting apparatus 10 of the present invention may be used to decorate trees and/or columns by alignment of the spine portion with, for example, the trunk of a tree and bending opposing arms around the trunk such that the trunk is encircled with lights. In the configuration depicted in FIG. 2, spine 30 supports arms 20 in vertically spaced relation running up the trunk of the tree. As should be apparent, the user may bend spine 30 to conform to any curvature present in the trunk or branch. Furthermore, flexible connector 36 allows spine 30 to be disposed in a highly angled configuration, including obtuse and acute angular configurations. Attachment to a tree trunk or branch is further facilitated by bending arms 20 circumferentially thereabout in a wrap around configuration. As further depicted in FIG. 8, a plurality of lighting apparatus, referenced as 10A–10E, may be connected in series to provide a substantially continuous illumination display on large trees or structures. The multiple outlet connector 42 provides for branching off of the lighting apparatus from the tree trunk to various tree branches without requiring that an additional power cord be provided. As depicted in FIG. 12, lighting apparatus may be installed in a horizontal configuration along the roofline of a house or building with the arms configured so as to hang downward to form illuminated display resembling suspended icicles. As noted hereinabove, the arms projecting from one side of spine 30 are preferably longer than the arms projecting from the opposing side such that the invention may be adapted for horizontal use to form an icicle display as depicted in FIG. 12 wherein the arms resemble vertically configured icicles of varying lengths. A plurality of lighting devices may be connected in series to stretch substantially around the perimeter of the building or structure.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What I claim is:

1. A decorative lighting apparatus comprising:

an elongate spine member having an upper end portion and a lower end portion;

a plurality of opposing projecting arms connected to said spine member, each arm having a first end connected to said spine member and a second free end, said arms longitudinally spaced along said spine and projecting from opposing sides thereof, each of said arms fabricated from bendable wire to allow for selective omni-directional bending of said arms;

each of said arms having a plurality of electric lamps spaced along the length thereof and electrical conductors connected to each of said electric lamps for supplying electric power to said electric lamps;

said electrical conductors connected to a male connector disposed proximal lower spine end and a female connector disposed proximal said upper spine end, said female connector including a plurality of electrical outlets for receiving a corresponding plurality of male electrical connectors.

2. A decorative lighting apparatus according to claim 1, wherein said apparatus is deployable from a compact, inoperative storage configuration wherein said upper and lower spine sections are folded in parallel relation about said flexible connector, to an operative configuration wherein said upper and lower spine sections form a generally continuous elongate spine.

3. A decorative lighting apparatus comprising:

an elongate spine having an upper end and a lower end, said spine including upper and lower elongate sections, said upper an lower sections connected by a flexible connector, each of said upper and lower sections fabricated from plastic coated wire to allow for selective omni-directional bending of said sections, said flexible connector allowing deployment of said apparatus from a compact, inoperative storage configuration wherein said upper and lower spine sections are folded in parallel relation about said flexible connector, to an operative configuration wherein said upper and lower spine sections form a generally continuous elongate spine;

a plurality of arms, each having a first end connected to said spine and a free end, said arms longitudinally spaced along said spine and projecting from opposing sides thereof, each of said arms fabricated from plastic coated wire to allow for selective omni-directional bending of said arms;

each of said arms having a plurality of electric lamps spaced along the length thereof and electrical conductors connected to said lamps for supplying electric power to said electric lamps;

said electrical conductors connected to a male connector disposed proximal lower end and a female connector disposed proximal said lower end, said female connector including a plurality of electrical outlets for receiving a corresponding plurality of male electrical connectors.

* * * * *